US005758717A

United States Patent [19]

Crossman

[11] Patent Number: 5,758,717

[45] Date of Patent: Jun. 2, 1998

[54] SYSTEM AND METHOD FOR THE RECOVERY OF WASTE HEAT FROM PIPELINES

[76] Inventor: William Crossman, P.O. Box 278, Bellevue, Alberta, Canada, T0K 0C0

[21] Appl. No.: 533,558

[22] Filed: Sep. 25, 1995

[51] Int. Cl.[6] ..... F28D 15/00

[52] U.S. Cl. ..... 165/45; 165/47; 165/909; 165/104.25; 165/904

[58] Field of Search ..... 165/47, 45, 904, 165/909, 163, 104.25, 104.11, 104.12, 901; 60/648; 62/87

[56] References Cited

U.S. PATENT DOCUMENTS

| | | | |
|---|---|---|---|
| 2,035,341 | 3/1936 | Radloff | 165/163 |
| 3,507,320 | 4/1970 | Russell | 165/210 |
| 4,006,857 | 2/1977 | Adrian | 60/648 |
| 4,120,157 | 10/1978 | Tang | 62/467 PR |
| 4,184,325 | 1/1980 | Mandrin | 165/104.25 |
| 4,184,856 | 1/1980 | Thoren | 165/909 |
| 4,219,074 | 8/1980 | Hansen | 165/104.11 |
| 4,231,226 | 11/1980 | Grienpentrog | 60/648 |
| 4,265,094 | 5/1981 | Haasis, Jr. | 165/163 |
| 4,294,311 | 10/1981 | Denis et al. | 165/104.14 |
| 4,413,670 | 11/1983 | Ritter | 165/104.12 |
| 4,420,950 | 12/1983 | Bodas et al. | 62/87 |
| 4,529,123 | 7/1985 | Johnson | 165/901 |
| 4,677,827 | 7/1987 | Shenoy et al. | 60/648 |
| 4,711,093 | 12/1987 | Markbreiter et al. | 62/87 |
| 4,727,854 | 3/1988 | Johnson | 165/901 |
| 5,054,541 | 10/1991 | Tripp | 165/45 |
| 5,297,620 | 3/1994 | Yabe et al. | 165/104.12 |
| 5,329,992 | 7/1994 | Tripp | 165/45 |
| 5,372,016 | 12/1994 | Rawlings | 165/45 |

FOREIGN PATENT DOCUMENTS

| | | | |
|---|---|---|---|
| 3521585 | 6/1985 | Germany | 62/238.6 |
| 228034 | 10/1985 | Germany | 62/238.6 |

*Primary Examiner*—John K. Ford

[57] ABSTRACT

Natural gas pipelines typically employ an underground large diameter pipe, on the order of about 42 inches in diameter, to conduct natural gas from a gas field to a place of consumption or to a shipping terminal. Compressor stations disposed along the pipeline compress the gas to maintain an acceptable rate of flow along the line. The compressing process heats the gas in the pipeline, and the heat is gradually lost to the ground along the length of the line. The present invention discloses a system and method for the recovery of such waste heat from a pipeline in which one or more recovery tubes or coils disposed underground, above or alongside the pipeline, carries a heat transfer fluid which collects the waste heat from the pipeline itself by a radiant transfer mechanism. The system may include a manifold and pumping system to utilize the heated heat transfer fluid to heat greenhouses, fish ponds, houses, and other facilities. The system may be employed to recover waste heat from any compressible fluid pipeline, such as natural gas, propane, butane, etc., and may also be used in connection with liquid fluids such as oil or gasoline which also generate heat when passing through pipelines.

20 Claims, 2 Drawing Sheets

SYSTEM AND METHOD FOR THE RECOVERY OF WASTE HEAT FROM PIPELINES

BACKGROUND OF THE INVENTION

1. Field of the Invention

The present invention relates to heat recovery systems and methods, and more particularly pertains to a system and method for the recovery and use of waste heat from pipelines, such as natural gas pipelines.

2. Description of the Prior Art

U.S. Pat. No. 4,184,856 issued to T. Thoren on Jan. 22, 1980 discloses a method for the utilization of heat energy from a domestic sewage system using a fan and heat exchanger for extracting waste heat from air directed through the sewer and subsequently exhausted through a sewer vent. U.S. Pat. No. 5,054,541 issued to B. Tripp on Oct. 8, 1981 discloses a ground coil assembly for use with a ground source heat pump. U.S. Pat. No. 5,329,992 issued on Jul. 19, 1994 to B. Tripp disclosed a prefabricated ground coil assembly intended for use with a ground source heat pump. U.S. Pat. No. 5,372,016 which issued to J. Rawlings on Dec. 13, 1994 discloses a ground source heat pump system including modular subterranean heat exchange units. German Patent Document DL 0228034 published Oct. 2, 1985 discloses a system for extracting heat from sewage pipes. German Patent Document No. 3521585 published Dec. 18, 1986 discloses another system for recovering heat from sewage systems.

The entire disclosures of each of the above listed U.S. Patents and German Patent Documents are hereby incorporated by reference herein.

SUMMARY OF THE INVENTION

Natural gas pipelines typically employ an underground large diameter pipe, on the order of about 42 inches in diameter, to conduct natural gas from a gas field to a place of consumption or to a shipping terminal. Such pipelines are referenced in the context of this document as "distribution pipelines." Compressor stations disposed along the pipeline compress the gas to maintain an acceptable rate of flow along the line. The compressing process heats the gas in the pipeline, and the heat is gradually lost to the ground along the length of the line. The present invention discloses a system and method for the recovery of such waste heat from a pipeline in which one or more recovery tubes or coils disposed underground, above or alongside the pipeline, carries a heat transfer fluid which collects the waste heat from the pipeline itself by a radiant transfer mechanism. The system may include a manifold and pumping system to utilize the heated heat transfer fluid to heat greenhouses, fish ponds, houses, and other facilities. The system may be employed to recover waste heat from any compressible fluid pipeline, such as natural gas, propane, butane, etc., and may also be used in connection with liquid fluids such as oil or gasoline which also generate heat when passing through pipelines.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
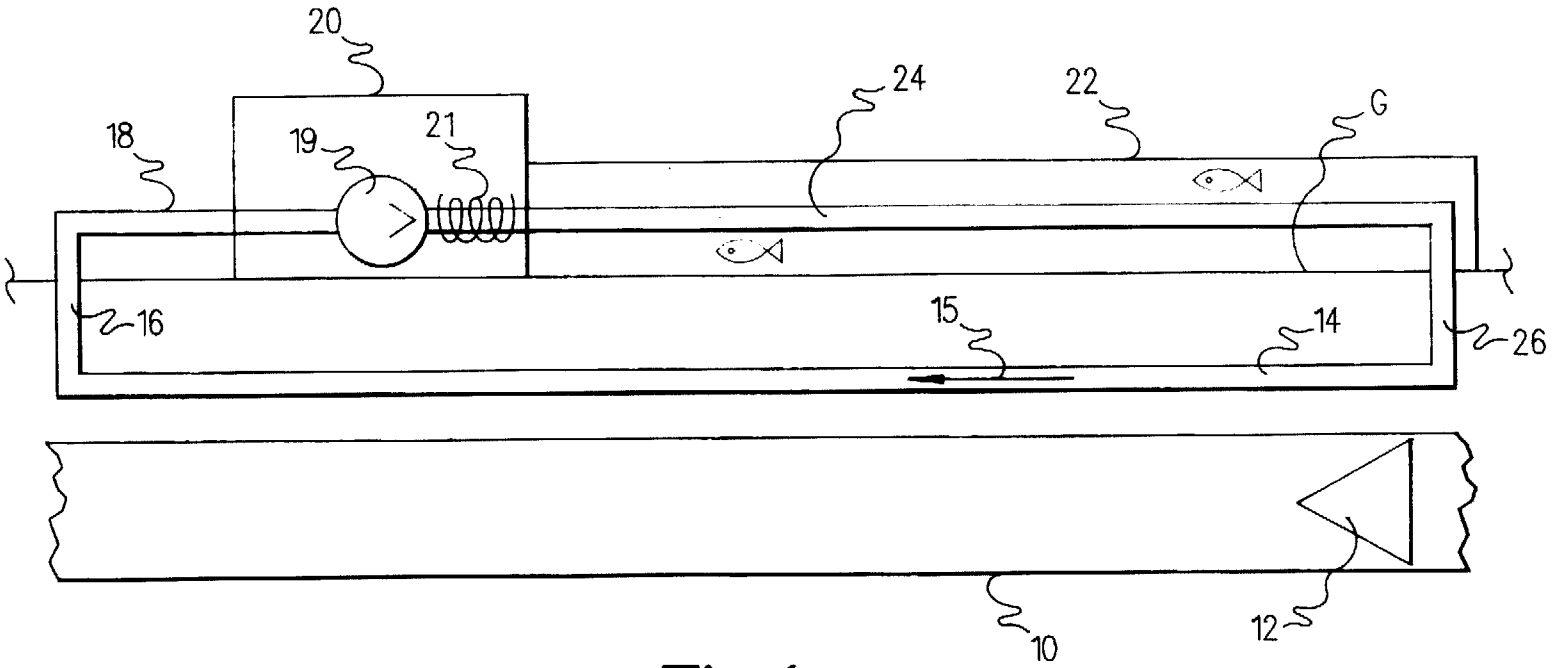
FIG. 1 is a diagrammatic view of a heat recovery system according to the present invention for the recovery and reuse of waste heat from a natural gas pipeline.

Referring now to the drawings, wherein like reference numerals designate corresponding structure throughout the views, and referring in particular to FIG. 1, an improved system for recovering waste heat from a pipeline 10 according to a first preferred embodiment of the invention includes a heat recovery tube 14 disposed adjacent and above a large diameter natural gas pipeline 10, which pipeline is conventionally buried about six to eight feet below the ground surface G. Conventionally, a plurality of compressor stations 12 are disposed along the pipeline 10, for the purpose of compressing the natural gas to increase the flow rate along the pipeline. Such pipelines are referenced in the context of this document as "distribution pipelines." In this process, heat is introduced in the pipeline, which is conventionally lost to the ground, resulting in a substantially warmer ground region adjacent and particularly above the pipeline in cold climate regions. A typical temperature of a natural gas line buried below ground is in the range of about thirty to forty degrees Celsius. A heat transfer fluid 15, such as a glycol or alcohol based antifreeze mixture, or other suitable liquid or gas, circulates through the tube 14 by means of a pump 19 disposed within a building 20 and connected to a vertical leg or manifold 16 of the tube 14 at a pump inlet 18. The heat transfer fluid 15 collects heat by radiant transfer from the pipeline 10, and transfers the recovered heat to the building 20 by means of a heat exchanger 21. The heat transfer fluid then flows through a tube portion 21 disposed within a fish pond or tank 22 for the purpose of heating the fish pond to assist in growing fish at a facility such as a hatchery or fish farm. The now cooled fluid 15 then passes downwardly through return line or manifold 26 to again flow along the heat transfer tube 14 adjacent the pipeline 10.

The building 20 might alternatively or additionally comprise a greenhouse, residence, or other structure. Further, the heat transfer fluid may be employed to heat only a fish pond, or only a building, or other facility, and need not necessarily be used to heat two facilities.

Figure 4:
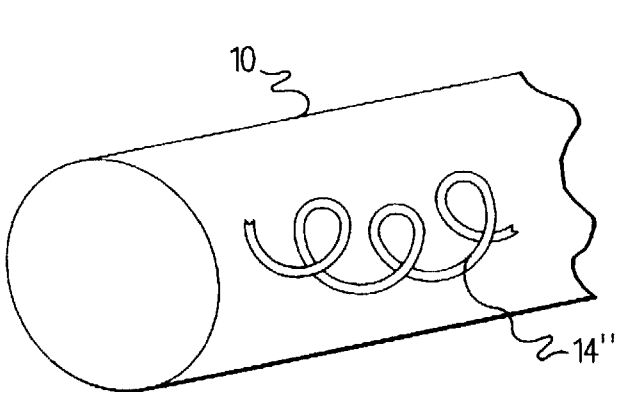
FIG. 4 is a diagrammatic perspective view illustrating still another example arrangement of a heat recovery tube relative to a pipeline.
Figure 2:
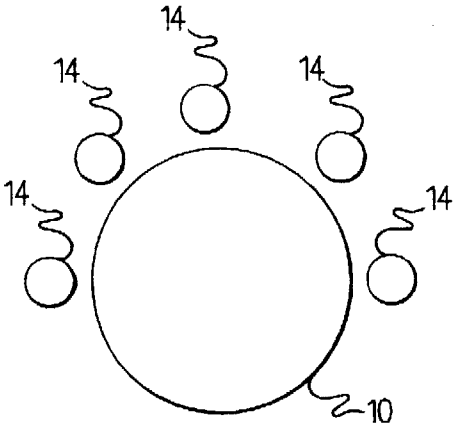
FIG. 2 is a diagrammatic end elevational view illustrating one example arrangement of heat recovery tubes relative to a pipeline.
Figure 3:
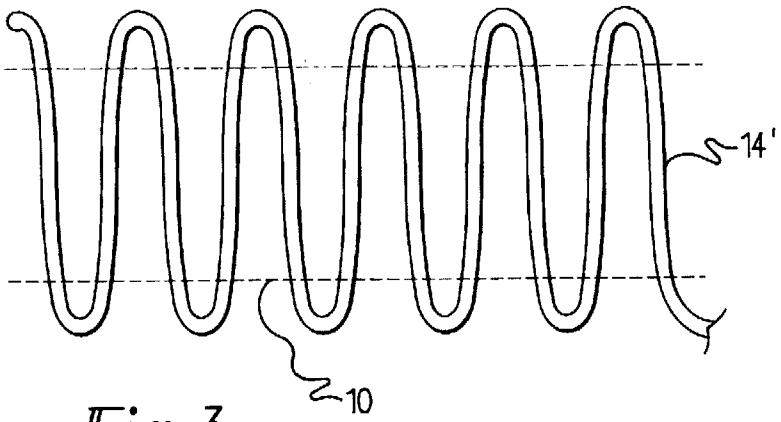
FIG. 3 is a diagrammatic top plan view illustrating another example arrangement of a heat recovery tube relative to a pipeline.

With reference to FIGS. 2 through 4, the particular configuration and arrangement of the heat transfer tubes 14 relative to the pipeline 10 may also vary within the scope of the present invention. For example, FIG. 2 illustrates a plurality of tubes 14 disposed above and alongside the pipeline 10. FIG. 3 illustrates a tube 14' disposed above the pipeline 10 and having a serpentine configuration. FIG. 4 illustrates a tube 14" having a helical coil configuration disposed alongside and adjacent to the pipeline 10. Preferably, the tube(s) or coil(s) 14 are not disposed below the pipeline 10 because the heat radiates in an upward direction. Further, disposition of a coil surrounding the pipeline 10 is considered disadvantageous due to the expense of installation. Preferably, the heat transfer tubes comprise a plurality of tubes or coils disposed above and alongside, adjacent to the pipeline 10, so as to collect heat directly from the pipeline itself.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method for recovering heat from a hydrocarbon distribution pipeline, comprising the steps of:

disposing at least one heat recovery tube adjacent a distribution pipeline located outdoors, including at least one compressor station, and having a compressible hydrocarbon product flowing therethrough;

passing a heat transfer fluid through said at least one heat recovery tube to collect heat by radiant transfer from said pipeline; and recovering heat from said heat transfer fluid for reuse.

2. The method of claim 1, further comprising the step of disposing a plurality of heat recovery tubes above and alongside said pipeline.

3. The method of claim 1, wherein said heat recovery tube comprises a coil.

4. The method of claim 1, further comprising the step of reusing said recovered heat to heat a fish pond.

5. The method of claim 1, further comprising the step of reusing said recovered heat to heat a greenhouse.

6. The method of claim 1, further comprising the step of reusing said recovered heat to heat a building.

7. The method of claim 1, further comprising the step of circulating said heat transfer fluid in said heat recovery tube by means of a pump.

8. The method of claim 1, wherein said heat transfer fluid comprises a gas.

9. The method of claim 1, wherein said heat transfer fluid comprises a liquid.

10. The method of claim 1, wherein said compressible hydrocarbon product comprises natural gas.

11. A method for recovering heat from a hydrocarbon distribution pipeline, comprising the steps of:

disposing at least one heat recovery tube adjacent a distribution pipeline located outdoors, including at least one pumping station, and having a hydrocarbon product flowing therethrough;

passing a heat transfer fluid through said at least one heat recovery tube to collect heat by radiant transfer from said pipeline; and recovering heat from said heat transfer fluid for reuse.

12. A system for recovering heat from a hydrocarbon distribution pipeline, comprising:

at least one heat recovery tube disposed adjacent a distribution pipeline located outdoors, including at least one compressor station, and having a compressible hydrocarbon product flowing therethrough;

a heat transfer fluid passing through said at least one heat recovery tube to collect heat by radiant transfer from said pipeline; and a heat exchanger for recovering heat from said heat transfer fluid for reuse.

13. The system of claim 12, further comprising a plurality of heat recovery tubes disposed above and alongside said pipeline.

14. The system of claim 12, wherein said heat recovery tube comprises a coil.

15. The system of claim 12, further comprising a fish pond associated with said heat exchanger such that said recovered heat heats said fish pond.

16. The system of claim 12, further comprising a greenhouse associated with said heat exchanger such that said recovered heat heats said greenhouse.

17. The system of claim 12, further comprising a building associated with said heat exchanger such that said recovered heat heats said building.

18. The system of claim 12, further comprising a pump for circulating said heat transfer fluid in said heat recovery tube.

19. The system of claim 12, wherein said heat transfer fluid comprises a gas.

20. The system of claim 12, wherein said heat transfer fluid comprises a liquid.

* * * * *